US006973729B2

(12) United States Patent
Nordlin

(10) Patent No.: US 6,973,729 B2
(45) Date of Patent: Dec. 13, 2005

(54) KNOCKOUT PUNCH WITH PILOT HOLE LOCATOR

(75) Inventor: William F. Nordlin, Poplar Grove, IL (US)

(73) Assignee: Greenlee Textron Inc., Rockford, IL (US)

( * ) Notice: Subject to any disclaimer, the term of this patent is extended or adjusted under 35 U.S.C. 154(b) by 125 days.

(21) Appl. No.: 10/085,730

(22) Filed: Feb. 28, 2002

(65) Prior Publication Data

US 2003/0159561 A1 Aug. 28, 2003

(51) Int. Cl.[7] ..... B26F 1/14

(52) U.S. Cl. ..... 30/360; 30/362; 30/366; 83/685; 83/686; 83/689

(58) Field of Search ..... 30/360, 362, 366; 83/681, 684–686, 689, 696, 743, 745, 690, 631, 626; 408/211–213, 224, 102

(56) References Cited

U.S. PATENT DOCUMENTS

| | | | | |
|---|---|---|---|---|
| 161,968 A | | 4/1875 | Kennedy | |
| 1,721,007 A | | 7/1929 | Doherty et al. | |
| 1,817,223 A | * | 8/1931 | Abramson et al. | 30/360 |
| 2,096,778 A | | 10/1937 | Azer | |
| 2,145,725 A | * | 1/1939 | Jamieson | 30/366 |
| 2,176,943 A | | 10/1939 | Reeser | |
| 2,237,069 A | * | 4/1941 | Christenson | 30/360 |
| 2,735,489 A | | 2/1956 | Fowler | |
| 3,255,526 A | * | 6/1966 | Molitor | 30/360 |
| 3,269,011 A | * | 8/1966 | Herrstrum | 30/360 |
| 3,683,499 A | | 8/1972 | Robinson, Jr. | |
| 3,728,927 A | | 4/1973 | Pfleiderer et al. | |
| 3,800,419 A | | 4/1974 | Hughes, Jr. | |
| 4,087,913 A | | 5/1978 | Jackson | |
| 4,353,164 A | | 10/1982 | Linquist et al. | |
| 4,403,417 A | | 9/1983 | Wilson et al. | |
| 4,543,722 A | | 10/1985 | Adleman et al. | |
| 4,594,779 A | | 6/1986 | Hagemeyer | |
| 4,724,616 A | | 2/1988 | Adleman et al. | |
| 4,739,687 A | | 4/1988 | Wanner et al. | |
| 4,830,548 A | * | 5/1989 | Kandarian | 408/1 R |
| 4,899,447 A | | 2/1990 | Adleman | |
| 4,905,557 A | | 3/1990 | Adleman | |
| 5,029,392 A | | 7/1991 | Bingham et al. | |
| 5,727,436 A | | 3/1998 | Swedberg et al. | |

OTHER PUBLICATIONS

Five pages from Greenlee Catalog No. 79 issued in Sep. 1979—Timesaving Tools for Electricians, Maintenance Men and Industry.
Ten pages from Greenlee Catalog MA–1024—Nov. 1993—Tools Testers, and Accessories.

* cited by examiner

*Primary Examiner*—Allan N. Shoap
*Assistant Examiner*—Phong Nguyen
(74) *Attorney, Agent, or Firm*—Trexler, Bushnell, Giangiorgi, Blackstone & Marr, Ltd.

(57) ABSTRACT

A knockout punch is provided with a member such that when the punch and the die are drawn together by the draw stud to make a hole in a workpiece, the member on the punch will locate the punch assembly in a pilot hole. In three embodiments of the invention, the member is formed integrally with the punch and extends from the punch proximate to a bore in the punch which is used to connect the punch to the draw stud. In another embodiment of the invention, the member is provided as an insert which is connected to the punch within a counterbore. The punch is also provided with a pair of piercing portions for piercing through the workpiece after the member has centered the punch assembly with the pilot hole and a pair of cutting portions for shearing the workpiece after the piercing portions have pierced the workpiece.

8 Claims, 6 Drawing Sheets

KNOCKOUT PUNCH WITH PILOT HOLE LOCATOR

BACKGROUND OF THE INVENTION

The present invention relates to an improved knockout punch which is used in conjunction with a punch driver to punch holes in sheet metal, for example, in the walls of electrical cabinets, aluminum, fiberglass and plastic.

Generally, when a hole is to be punched in an electrical cabinet, a small hole is first drilled in the wall of the electrical cabinet. A first end of a draw stud is threaded into a ram of a hydraulic punch driver. A second end of the draw stud is inserted through a punching die and then through the drilled hole, the draw stud having a circumference that is less than the circumference of the drilled hole. A knockout punch is threaded onto the second end of the draw stud on the opposite side of the electrical cabinet than is the punching die and the hydraulic punch driver.

An operator actuates a hand pump of the hydraulic punch driver. When the hand pump of the hydraulic punch driver is actuated, hydraulic fluid forces the ram to pull the draw stud. The draw stud, in turn, pulls the knockout punch through the electrical cabinet into the die such that the desired hole size is punched.

Knockout punches used in the prior art, such as standard round knockout punches, SLUG BUSTER® knockout punches sold by Greenlee Textron Inc., the assignee of the present invention, and those embodied in U.S. Pat. No. 4,353,164, which is owned by Greenlee Textron Inc., the assignee of the present invention, while proving very effective in the marketplace, suffer from a number of disadvantages.

One such disadvantage is that the prior art knockout punches do not provide means for locating the punch assembly in a pilot hole as the knockout punch and the die are drawn together by the draw stud to make a hole in the workpiece. Presently, an operator locates the punch assembly in a pilot hole by using "alignment marks" which can be difficult to see by the operator and may allow for error such that the hole to be created may not be properly positioned.

Another such disadvantage is that the prior art knockout punches typically have an elevated punching force at the beginning as the punch pierces the workpiece because the punch is working against a large length of the workpiece before the points of the punch fully pass through the workpiece.

Yet another such disadvantage is that the prior art knockout punches typically have an elevated punching force at the end of the punching cycle. The standard punch has a high punching force at the end of the punching cycle because it is shearing on four lines simultaneously and the angle of the punch faces reduces to zero at the end. The SLUG BUSTER® punch also has a high punching force at the end of the punching cycle because the long angled punch surfaces are "v" shaped, shearing on four lines simultaneously as the angle of the punch face reduces to zero toward the end of the punching cycle.

Another such disadvantage of the prior art knockout punches is that they do not have only planar surfaces which can be machined with standard cutting tools, such that custom formed tools or broaches are required to form the prior art knockout punches.

Thus, it is desirable to have a knockout punch which incorporates all of the advantages of the prior art knockout punches, but which overcomes the disadvantages of the prior art knockout punches, such as those identified above.

The invention, as described herein, provides such a knockout punch. Other features and advantages of the knockout punch of the present invention will become apparent upon a reading of the attached specification in combination with a study of the drawings.

OBJECTS AND SUMMARY OF THE INVENTION

A primary object of the invention is to provide a knockout punch which improves punch alignment over prior art devices, such as the current difficult to see alignment marks.

An object of the invention is to provide a knockout punch which automatically locates on a drilled pilot hole.

Another object of the invention is to provide a knockout punch which reduces the initial piercing force.

Yet another object of the invention is to provide a knockout punch which reduces the punching force at the end of the punching cycle.

An object of the invention is to provide a knockout punch which is lower in cost to manufacture than those found in the prior art.

Another object of the invention is to provide a knockout punch which requires a lower punching force to punch holes through a workpiece.

Yet another object of the invention is to provide a knockout punch which has a longer life than those found in the prior art.

Still another object of the invention is to provide a knockout punch which has only planar surfaces, allowing it to be machined with standard cutting tools.

Briefly, and in accordance with the foregoing, a novel knockout punch is provided. The knockout punch has a pilot hole locator provided therewith such that when the knockout punch and the die are drawn together by the draw stud to make a hole in a workpiece, for instance an electrical cabinet, the pilot hole locator on the knockout punch locates the punch assembly in the pilot hole. In one embodiment of the invention, the pilot hole locator is formed integrally with the knockout punch and extends from the knockout punch proximate to a bore in the knockout punch which is used to connect the knockout punch to the draw stud. In another embodiment of the invention, the pilot hole locator is provided as an insert which is connected to the knockout punch within a counterbore. In either embodiment, the knockout punch is also provided with a pair of piercing portions for piercing through the workpiece after the pilot hole locator has centered the punch assembly with the pilot hole and a pair of cutting portions for shearing the workpiece after the piercing portions have pierced the workpiece.

BRIEF DESCRIPTION OF THE DRAWINGS

The features of the present invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENTS

Figure 1:
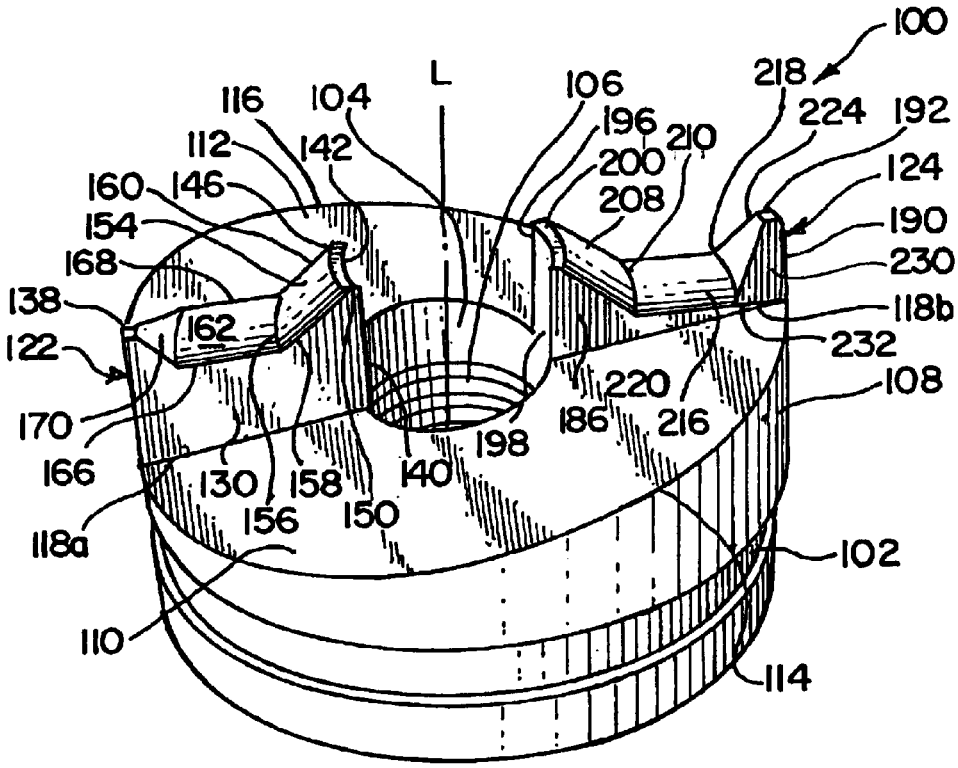
FIG. 1 is a perspective view of a first embodiment of a punch which incorporates features of the present invention.
Figure 2:
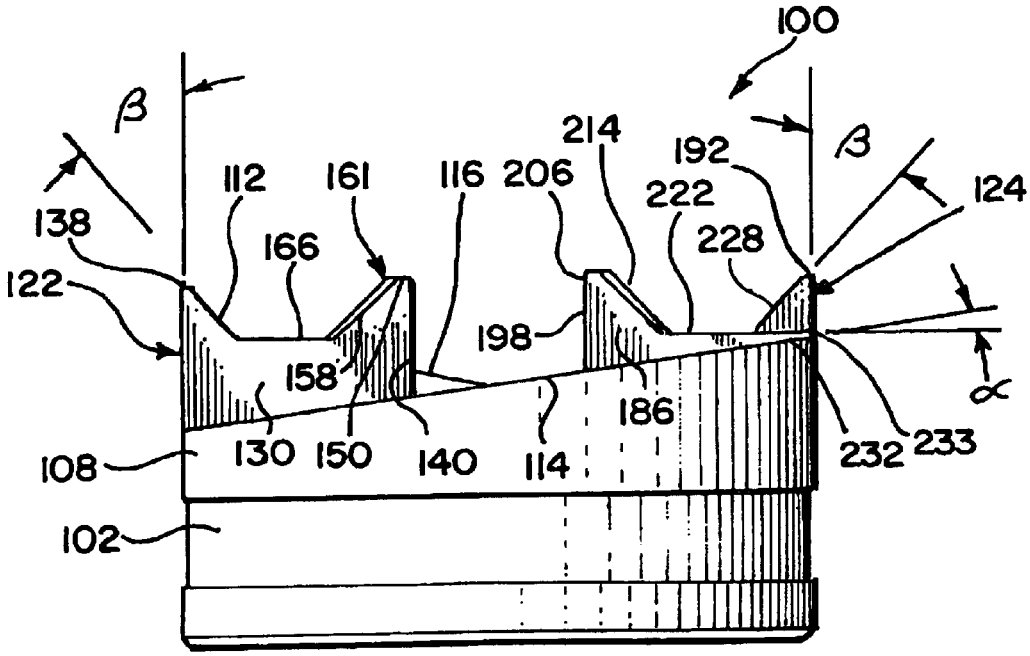
FIG. 2 is a side-elevational view of the punch of the first embodiment.
Figure 3:
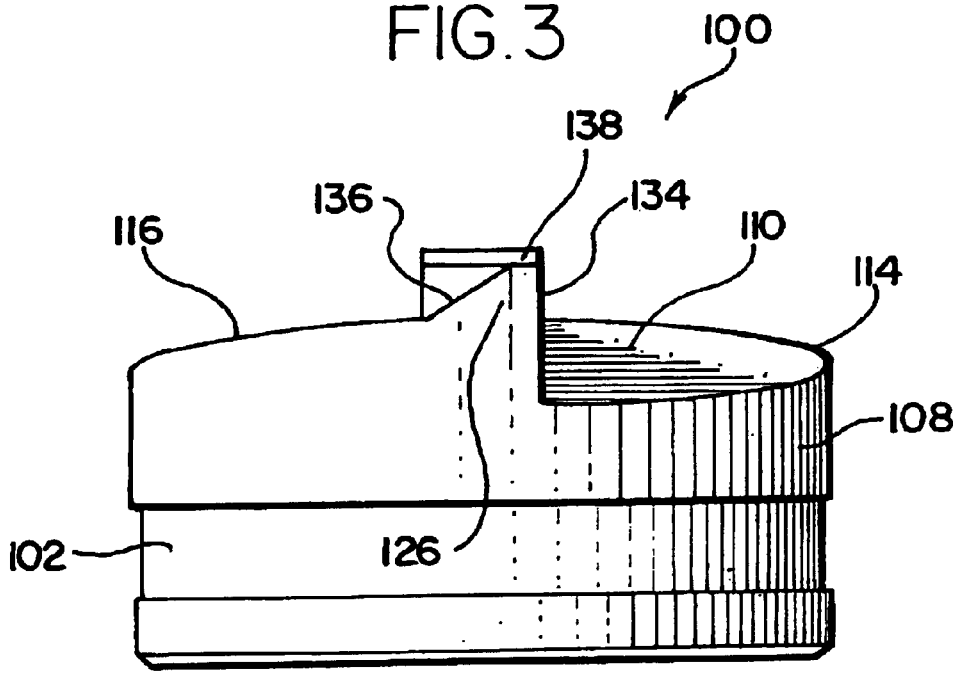
FIG. 3 is a side-elevational view of the punch of the first embodiment which is turned 90 degrees from the side-elevational view of the punch as illustrated in FIG. 2.
Figure 4:
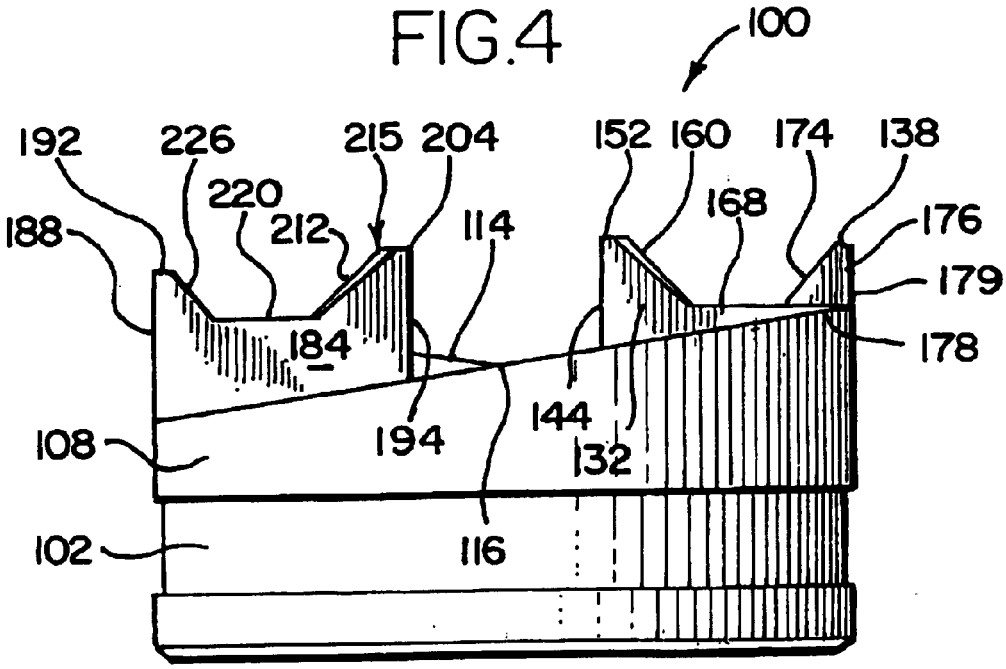
FIG. 4 is a side-elevational view of the punch of the first embodiment which is turned 180 degrees from the side-elevational view of the punch as illustrated in FIG. 2.

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated.

Figure 6:
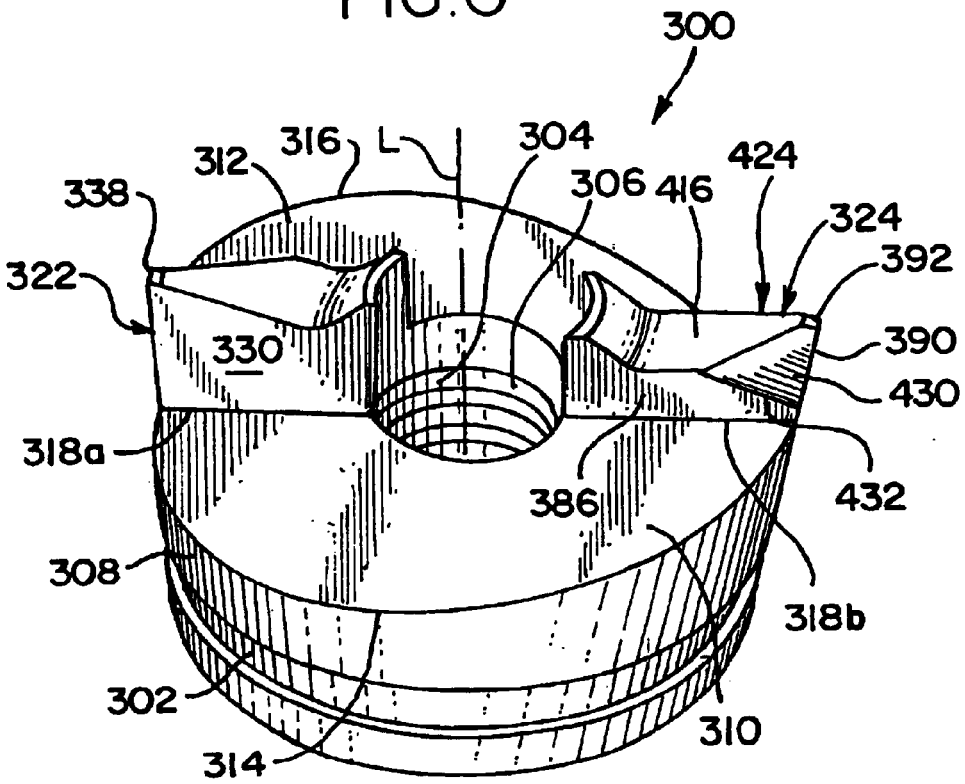
FIG. 6 is a perspective view of a second embodiment of the punch which incorporates features of the present invention.
Figure 7:
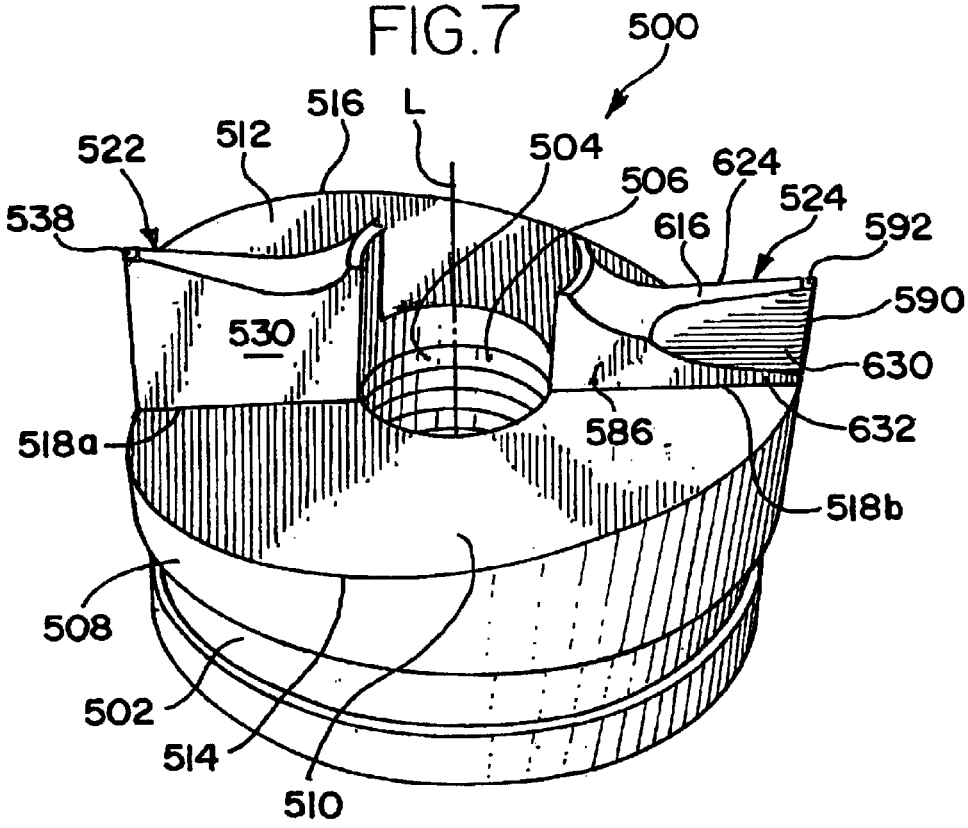
FIG. 7 is a perspective view of a third embodiment of the punch which incorporates features of the present invention.
Figure 8:
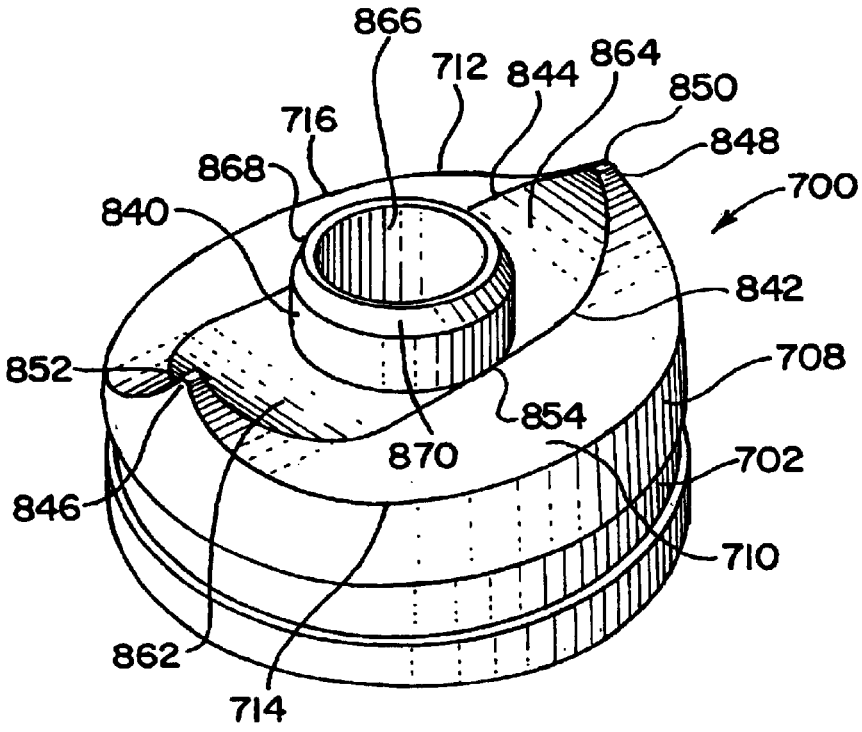
FIG. 8 is a perspective view of a fourth embodiment of the punch which incorporates features of the present invention.
Figure 9:
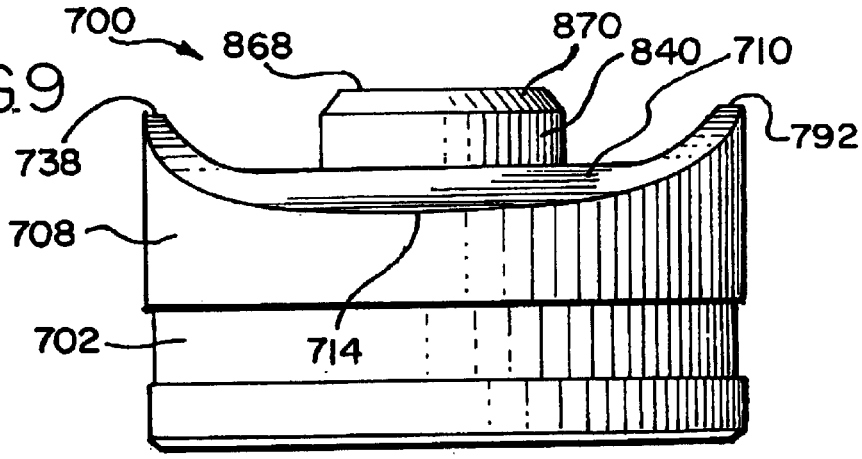
FIG. 9 is a side-elevational view of the punch of the fourth embodiment.
Figure 10:
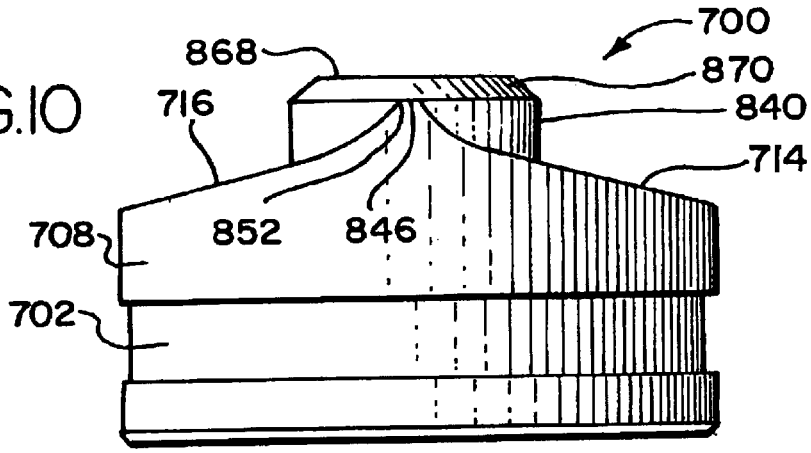
FIG. 10 is a side-elevational view of the punch of the fourth embodiment which is turned 90 degrees from the side-elevational view of the punch as illustrated in FIG. 9.
Figure 11:
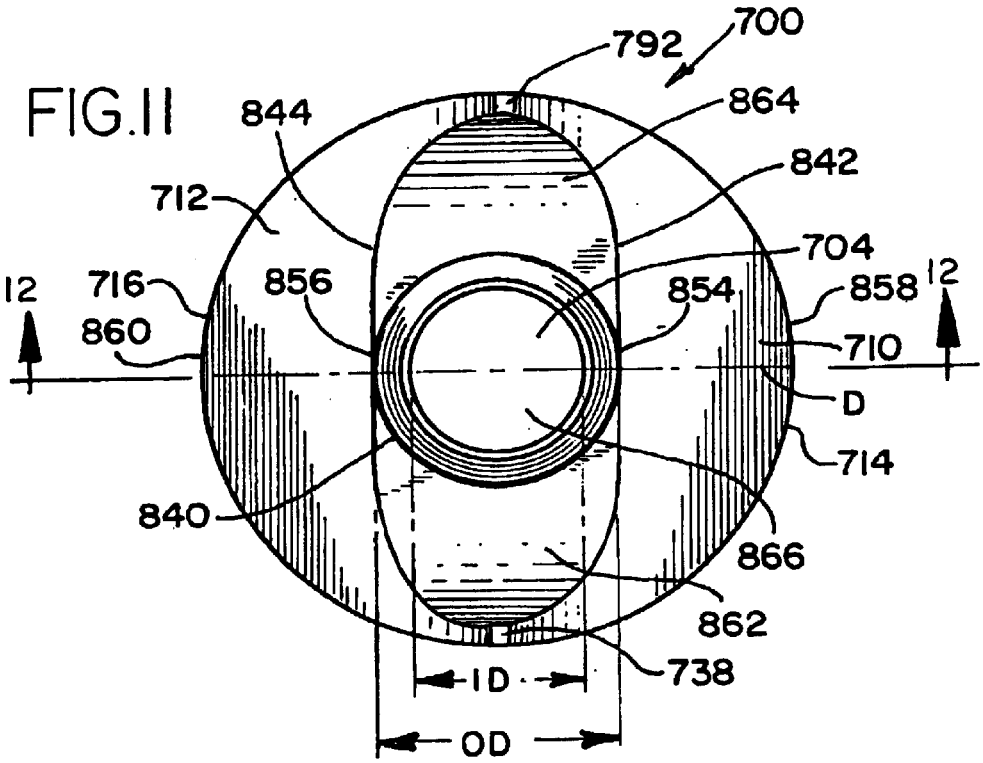
FIG. 11 is a top plan view of the punch of the fourth embodiment as illustrated in FIG. 8.
Figure 12:
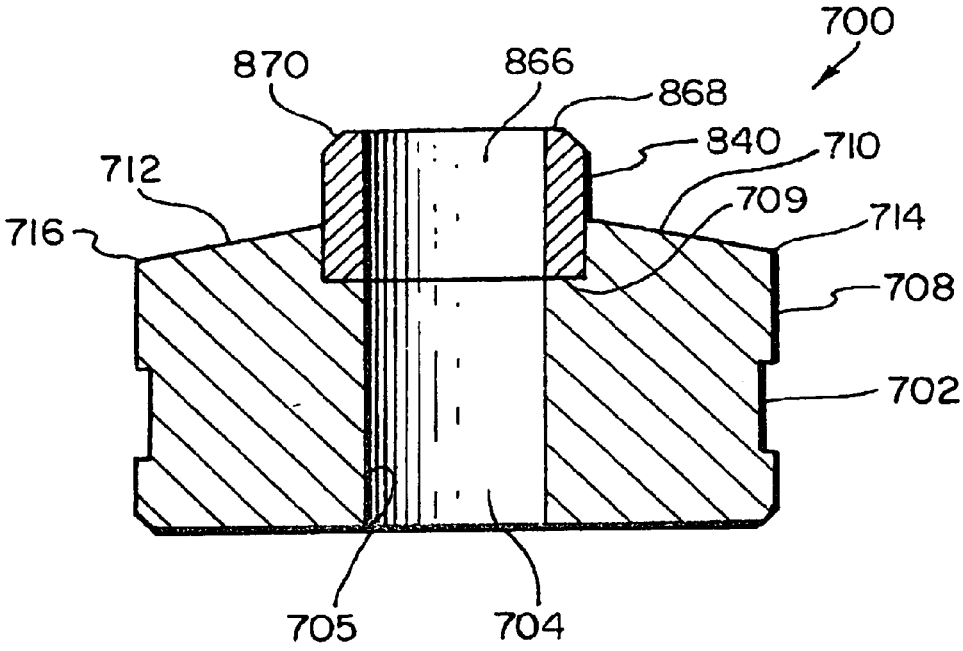
FIG. 12 is a cross-sectional view of the punch of the fourth embodiment taken along line 12—12 of FIG. 11.

A knockout punch is provided. A first embodiment of the knockout punch 100 is illustrated in FIGS. 1–5. A second embodiment of the knockout punch 300 is illustrated in FIG. 6. A third embodiment of the knockout punch 500 is illustrated in FIG. 7. A fourth embodiment of the knockout punch 700 is illustrated in FIGS. 8–12. Like elements are denoted with like reference numerals with the reference numbers denoting the first embodiment being in the one and two hundreds, the reference numbers denoting the second embodiment being in the three and four hundreds, the reference numbers denoting the third embodiment being in the five and six hundreds, and the reference numbers denoting the fourth embodiment being in the seven and eight hundreds.

Each of the punches 100, 300, 500, 700 are useful for punching a hole through a workpiece (not shown), such as 10-gauge, type 304 stainless steel, which is typically used to form electrical cabinets. The punches 100, 300, 500, 700 are used with a die (not shown) which is well known in the art as well as a draw stud (not shown) which is also well known in the art. A first end of the draw stud is typically threaded to a ram (not shown) of a punch driver (not shown). A second end of the draw stud is inserted through the die and through a pilot hole (not shown) which is provided in the workpiece, the draw stud having a circumference that is less than the circumference of the pilot hole. The punches 100, 300, 500, 700 are then attached to the second end of the draw stud on the opposite side of the workpiece than is the die and the hydraulic punch driver.

An operator actuates a hand pump of the hydraulic punch driver. When the hand pump of the hydraulic punch driver is actuated, hydraulic fluid forces the ram to pull the draw stud. The draw stud, in turn, pulls the punch 100, 300, 500, 700 through the electrical cabinet into the die such that the desired hole size is punched.

Attention is now directed to the first embodiment of the punch 100 shown in FIGS. 1–5. The punch 100 includes a generally cylindrical punch body 102 and a punch face 108 having a passageway 104 extending axially therethrough. A wall 106 of the passageway 104 is typically threaded and threadably receives a threaded end of the draw stud in a conventional fashion. The working face 108 has a novel arrangement of inclined surfaces and associated cutting edges and surfaces for centering the punch 100, draw stud and die, which will be referred to collectively as the punch assembly, with the pilot hole, punching through the workpiece, and splitting apart of a slug to be removed from the workpiece.

Figure 5:
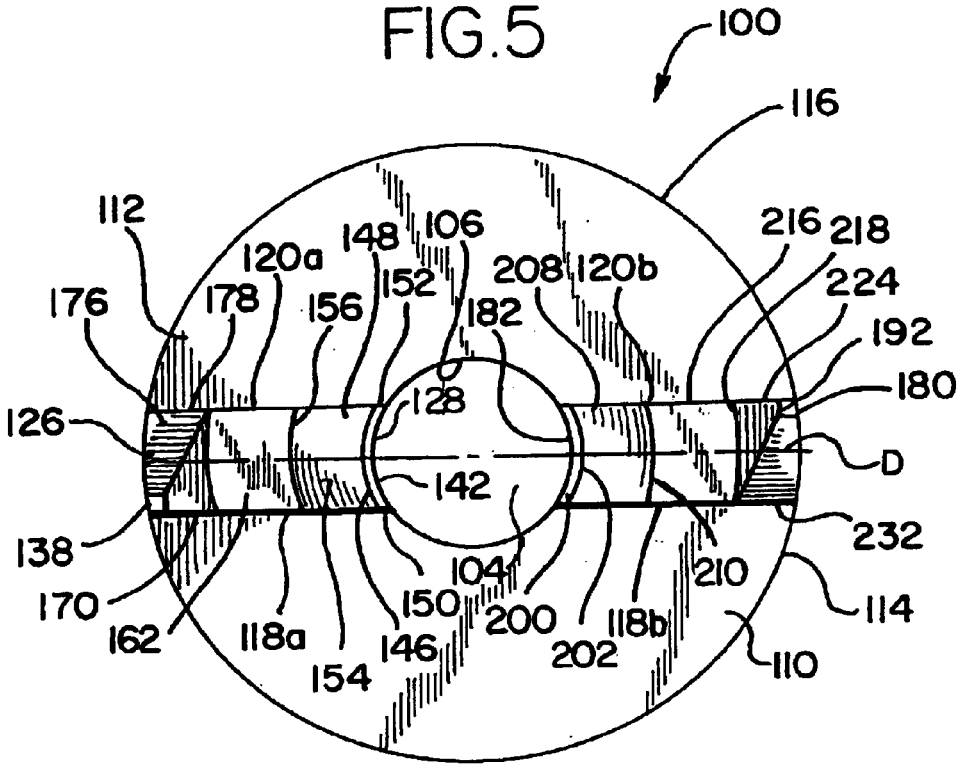
FIG. 5 is a top plan view of the punch of the first embodiment as illustrated in FIG. 2.

The working face 108 includes a pair of inclined planar surfaces 110, 112 on opposite sides of a line D, see FIG. 5, which corresponds to the diameter of the working face 108. The inclined planar surfaces 110, 112 slope upwardly from the punch body 102 in opposite directions at an angle $\alpha$. The inclined planar surfaces 110, 112 have outer circumferential or peripheral edges which form outer cutting edges 114, 116 around a large portion of the working face 108 periphery when viewed in the top plan shown in FIG. 5.

The inclined planar surface 110 has inner ends 118*a*, 118*b* parallel with and spaced from line D across the working face 108 in top plan view with inner edge 118*a* and inner edge 118*b* being on opposite sides of the passageway 104. The inclined planar surface 112 has inner ends 120*a*, 120*b* parallel with and spaced from line D across the working face 108 in top plan view with inner edge 120*a* and inner edge 120*b* being on opposite sides of said passageway 104.

The inclined planar surface 110 inclines at angle $\alpha$ from inner edge 118*a* to inner edge 118*b* such that inner edge 118*b* is positioned higher than the inner edge 118*a*. The inclined planar surface 112 inclines at angle $\alpha$ from inner edge 120*b* to inner edge 120*a* such that inner edge 120*a* is positioned higher than the inner edge 120*b*. Inner ends 118*a*, 120*b* are positioned at the same height while inner ends 118*b*, 120*a* are positioned at the same height.

The working face 108 includes an extension member 122 between the inner ends 118*a*, 120*a* and the passageway 104. Similarly, the working face 108 includes an extension member 124 between the inner ends 118*b*, 120*b* and the passageway 104.

The extension member 122 has an outer peripheral surface 126, an inner surface 128, a first side surface 130 which extends vertically from the inner edge 118*a* between the outer peripheral surface 126 and the inner surface 128, and a second side surface 132 which extends vertically from the inner edge 120*a* between the outer peripheral surface 126 and the inner surface 128.

The outer peripheral surface 126 is defined by first and second outer peripheral edges 134, 136. The first outer peripheral edge 134 extends vertically from an outer end of the inner edge 118*a* to a point 138 which is positioned at a height higher than both the inner edge 118*a* and the inner edge 120*a*. The second outer peripheral edge 136 tapers downwardly from the point 138 to an outer end of the inner edge 120*a*.

The inner surface 128 is defined by first, second and third inner edges 140, 142, 144. The first inner edge 140 extends vertically from an inner end of the inner edge 118*a* to a first end of the second inner edge 142. The third inner edge 144 extends vertically from an inner end of the inner edge 120*a* to a second end of the second inner edge 142. The second inner edge 142 is positioned at a height higher than the point 138, and is preferably positioned at a height of about 1/16 of an inch higher than the point 138. The inner surface 128 is an extension of the wall 106 of the passageway 104 and, therefore, is arced as is the wall 106 of the passageway 104. Thus, the second inner edge 142 is arced.

The extension member 122 has a first top surface 146 which extends horizontally from the second inner edge 142 toward the outer peripheral surface 126 to an outer edge 148. The first top surface 146 is generally arced and, therefore, the outer edge 148 is also generally arced. The first top surface 146 further has a first side edge 150 and a second side edge 152. The first side edge 150 is also an edge of the first side surface 130 while the second side edge 152 is also an edge of the second side surface 132.

The extension member 122 has a second top surface 154 which tapers downwardly and outwardly toward the outer peripheral surface 126 from the outer edge 148 to an outer edge 156. The second top surface 154 is generally arced and, therefore, the outer edge 156 is also generally arced. The second top surface 154 further has a first side edge 158 and a second side edge 160. The first side edge 158 is also an edge of the first side surface 130 while the second side edge 160 is also an edge of the second side surface 132.

The second top surface 154, the first top surface 146 and the inner surface 128 combine to form a tapered projection 161 of the extension member 122.

The extension member 122 has a third top surface 162 which extends horizontally from the outer edge 156 toward the outer peripheral surface 126 to an outer edge 164. The outer edge 164 is generally arced. The third top surface 162 further has a first side edge 166 and a second side edge 168. The first side edge 166 is also an edge of the first side surface 130 while the second side edge 168 is also an edge of the second side surface 132.

The extension member 122 has a fourth top surface 170 which tapers downwardly and inwardly toward the inner surface 128 from the point 138 to the outer edge 164. The fourth top surface 170 tapers downwardly at an angle β relative to an axial line L through the center of the passageway 104. The fourth top surface 170 further has a first side edge 172 and a second side edge 174. The first side edge 172 is also an edge of the first side surface 130.

The extension member 122 has a fifth top surface 176 which tapers downwardly toward the inner edge 120*a* from the point 138 to an edge 178. The edge 178 is also an edge of the second side surface 132. The second side edge 174 and the second outer peripheral edge 136 are the other edges of the fifth top surface 176.

The fourth top surface 170, the fifth top surface 176, the outer peripheral surface 126 and the point 138 combine to form a piercing portion 179 of the extension member 122.

The extension member 124 has an outer peripheral surface 180, an inner surface 182, a first side surface 184 which extends vertically from the inner edge 120*b* between the outer peripheral surface 180 and the inner surface 182, and a second side surface 186 which extends vertically from the inner edge 118*b* between the outer peripheral surface 180 and the inner surface 182.

The outer peripheral surface 180 is defined by first and second outer peripheral edges 188, 190. The first outer peripheral edge 188 extends vertically from an outer end of the inner edge 120*b* to a point 192 which is positioned at a height higher than both the inner edge 120*b* and the inner edge 118*b*. The second outer peripheral edge 190 tapers downwardly from the point 192 to an outer end of the inner edge 118*b*.

The inner surface 182 is defined by first, second and third inner edges 194, 196, 198. The first inner edge 194 extends vertically from an inner end of the inner edge 120*b* to a first end of the second inner edge 196. The third inner edge 198 extends vertically from an inner end of the inner edge 118*b* to a second end of the second inner edge 196. The second inner edge 196 is positioned at a height higher than the point 192, and is preferably positioned at a height of about 1/16 of an inch higher than the point 192. The inner surface 182 is an extension of the wall 106 of the passageway 104 and, therefore, is arced as is the wall 106 of the passageway 104. Thus, the second inner edge 196 is arced.

The extension member 124 has a first top surface 200 which extends horizontally from the second inner edge 196 toward the outer peripheral surface 180 to an outer edge 202. The first top surface 200 is generally arced and, therefore, the outer edge 202 is also generally arced. The first top surface 200 further has a first side edge 204 and a second side edge 206. The first side edge 204 is also an edge of the first side surface 184 while the second side edge 206 is also an edge of the second side surface 186.

The extension member 124 has a second top surface 208 which tapers downwardly and outwardly toward the outer peripheral surface 180 from the outer edge 202 to an outer edge 210. The second top surface 208 is generally arced and, therefore, the outer edge 210 is also generally arced. The second top surface 208 further has a first side edge 212 and a second side edge 214. The first side edge 212 is also an edge of the first side surface 184 while the second side edge 214 is also an edge of the second side surface 186.

The second top surface 208, the first top surface 200 and the inner surface 182 combine to form a tapered projection 215 of the extension member 124.

The extension member 124 has a third top surface 216 which extends horizontally from the outer edge 210 toward the outer peripheral surface 180 to an outer edge 218. The outer edge 218 is generally arced. The third top surface 216 further has a first side edge 220 and a second side edge 222. The first side edge 220 is also an edge of the first side surface 184 while the second side edge 222 is also an edge of the second side surface 186.

The extension member 124 has a fourth top surface 224 which tapers downwardly and inwardly toward the inner surface 182 from the point 192 to the outer edge 218. The fourth top surface 224 tapers downwardly at an angle β relative to the axial line L. The fourth top surface 224 further has a first side edge 226 and a second side edge 228. The first side edge 226 is also an edge of the first side surface 184.

The extension member 124 has a fifth top surface 230 which tapers downwardly toward the inner edge 118*b* from the point 192 to an edge 232. The edge 232 is also an edge of the second side surface 186. The second side edge 228 and the second outer peripheral edge 190 are the other edges of the fifth top surface 230.

The fourth top surface 224, the fifth top surface 230, the outer peripheral surface 180 and the point 192 combine to form a piercing portion 233 of the extension member 224.

The extension members 122, 124 are preferably identical to one another, but are oppositely arranged.

Operation of the punch 100 will now be discussed. As explained above, an operator threads a first end of a draw stud to a ram of a punch driver. A second end of the draw stud is inserted through a die and through a pilot hole which is provided in a workpiece, the draw stud having a circumference which is less than the circumference of the pilot hole. The punch 100 is then attached to the second end of the draw stud on the opposite side of the workpiece than is the die and the hydraulic punch driver. The punch 100 is attached to the draw stud by threading the second end of the draw stud into the passageway 104 of the punch 100 which has a threaded wall 106.

In the preferred embodiment, the operator turns the punch 100 onto the draw stud until the punch 100 and the die are tight on the workpiece and the tapered projections 161, 215, which are positioned adjacent to the draw stud, enter the pilot hole and cause the punch 100, the draw stud and die to center on the pilot hole. The operator could also actuate a hydraulic punch driver until the punch 100 and the die are tight on the workpiece.

After the tapered projections 161, 215 enter the pilot hole to center the punch 100, the operator actuates a hand pump of the hydraulic punch driver such that hydraulic fluid forces the ram pull the draw stud, which in turn pulls the punch 100 such that the points 138, 192 pierce through the workpiece and the workpiece is cut along the fourth and fifth top surfaces 170, 176; 224, 230.

After the workpiece is cut along the fourth and fifth top surfaces 170, 176; 224, 230, and the points 138, 192 have fully passed through the workpiece, the inclined planar surfaces 110, 112 begin shearing the workpiece to create a hole having a diameter equivalent to the diameter of the working face 108, which is larger than a diameter of the pilot hole. As the points 138, 192 pierce through the workpiece, lateral cutting or splitting of a slug (not shown) is initiated from a slug periphery (defined by the diameter of the working face 108) toward a slug center (defined by the pilot hole through the workpiece) before a significant part of the slug periphery is cut by the outer edges 114, 116 of the inclined planar surfaces 110, 112. With further penetration, lateral splitting of the slug continues and preferably is substantially complete before the outer cutting edges 114, 116 begin cutting their portion of the slug periphery. The entire slug periphery is thus cut and the slug is split apart into two pieces for easy removal from the draw stud and the die.

The configuration of the punch 100, in comparison to punches of the prior art, reduces the initial piercing force by reducing the area of contact between the punch 100 and the workpiece. The two points 138, 192 have steep tapers and are high enough that the points 138, 192 have fully passed through the workpiece before the inclined planar surfaces 110, 112 begin shearing the hole. In prior art punches, the punches work against a greater length of the workpiece before the points fully pass through the workpiece.

The configuration of the punch 100 also maintains a constant shearing angle throughout the punching cycle except for the points 138, 192 used to initially pierce the workpiece. Prior art punches typically have an elevated punching force at the end of the punching cycle. In one prior art punch, the punching force is high because the punch is shearing on four lines simultaneously and the angle of the punch face reduces to zero at the end of the punching cycle. In another prior art punch, the inclined planar surfaces of the punch are "v" shaped, shearing on four lines simultaneously as the angle of the punch face reduces to zero toward the end of the punching cycle.

The configuration of the punch 100 also is advantageous because the punch 100 has only planar surfaces which can be machined with standard cutting tools. Unlike prior art punches, no custom form tools or broaches are required.

FIG. 6 illustrates a second embodiment of the punch 300 where the angle β (not shown) is larger than the angle β as illustrated in FIGS. 1–5 and FIG. 7 illustrates a third embodiment of the punch 500 where the angle β (not shown) is larger than the angle β of the second embodiment of the punch 300. Further discussion of the second and third embodiments of the punches 300, 500, with the larger angles β will not be discussed herein as the remainder of the punches 300, 500 are identical to the punch 100 except with regard to dimensions.

Attention is now directed to the fourth embodiment of the punch 700 shown in FIGS. 8–12. The punch 700 includes a generally cylindrical punch body 702 and a working face 708 having a passageway 704 extending axially therethrough. A wall 705 of the passageway is typically threaded and threadedly receives a threaded end of the draw stud in conventional fashion. The working face 708 has an arrangement of inclined surfaces and associated cutting edges. An insert 840 extends from the working face 708 and is permanently fastened into a counterbore 709 of the passageway 704 and is used for centering the punch 700, draw stud and die with the pilot hole prior to the punch 700 punching through the workpiece.

The working face 708 includes a pair of inclined planar surfaces 710, 712 on opposite sides of line D, which corresponds to the diameter of the working face 708. The inclined planar surfaces 710, 712 are generally crescent-shaped such that outer circumferential edges 714, 716 of the inclined planar surfaces 710, 712 are convex while the inner edges 842, 844 thereof are concave. The outer circumferential or peripheral edges 714, 716 act as outer cutting edges 714, 716 around a large portion of the periphery of the working face 708 when viewed in the top plan shown in FIG. 11. The inclined planar surfaces 710, 712 slope upwardly from the outer cutting edges 714, 716 to the inner edges 842, 844 of the inclined planar surfaces 710, 712.

The inclined planar surface 710 has a first end 846 and a second end 848. The inclined planar surface 712 has a first end 850 and a second end 852. The first and second ends 846, 848 of the inclined planar surface 710 are positioned at the same height as the first and second ends 850, 852 of the inclined planar surface 712. The first and second ends 846, 850; 848, 852 of the inclined planar surfaces 710, 712 are positioned at a height which is higher than a middle portion 854, 856 of the inner edges 842, 844 of the inclined planar surfaces 710, 712, which in turn, are positioned at a height which is higher than a middle portion 858, 860 of the outer edges 714, 716 of the inclined planar surfaces 710, 712. The middle portion 854, 856 of the inner edges 842, 844 borders the wall 705 of the passageway 704 at the counterbore 709 thereof.

The first end 846 of the inclined planar surface 710 is connected to the second end 852 of the inclined planar surface 712 at a point 738. The second end 848 of the inclined planar surface 710 is connected to the first end 850 of the inclined planar surface 712 at a point 792.

The working face 708 further includes a pair of top surfaces 862, 864. The top surface 862 extends from the point 738 to the wall 705 of the passageway 704 at the counterbore 709 such that the top surface 862 is bordered by the inner edge 842 of the inclined planar surface 710 from the point 738 to the middle portion 854 thereof, the inner edge 844 of the inclined planar surface 712 from the point 738 to the middle portion 856 thereof, and the wall 705 of the passageway 704 at the counterbore 709. The top surface 864 extends from the point 792 to the inner edge 842 of the inclined planar surface 710 from the point 792 to the middle portion 854 thereof, the inner edge 844 of the inclined planar surface 712 from the point 792 to the middle portion 856 thereof, and the wall 705 of the passageway 704 at the counterbore 709.

The insert 840 is preferably cylindrical and has an aperture 866 therethrough. The insert 840 is capable of being permanently fastened into the counterbore 709 of the punch 700 by press fitting, welding, threading or bolting, or by any other suitable means. The insert 840 extends upwardly from the counterbore 709 to a top 868 thereof. The top 868 of the insert 840 is preferably positioned at a height of about 1/16 of an inch higher than the points 738, 792. The top 868 of the insert 840 further has a chamfered edge 870 from an inner diameter ID of the insert 840 to an outer diameter OD of the insert 840. The chamfered edge 870 preferably angles downwardly and outwardly at an angle between approximately 30 degrees and 45 degrees. The inner diameter ID of the insert 840 is preferably of the same diameter as the passageway 704 of the punch 700 such that the draw stud can also be threaded into the aperture 842 of the insert 840 if required.

Operation of the punch 700 will now be discussed. As explained above, an operator threads a first end of a draw stud to a ram of a punch driver. A second end of the draw stud is inserted through a die and through a pilot hole which is provided in a workpiece, the draw stud having a circumference which is less than the circumference of the pilot hole. The punch 700 is then attached to the second end of the draw stud on the opposite side of the workpiece than is the die and the hydraulic punch driver. The punch 700 is attached to the draw stud by threading the second end of the draw stud into the passageway 704 of the punch 700 which has a threaded wall, with the draw stud extending through the insert 840.

In the preferred embodiment, the operator turns the punch 700 onto the draw stud until the punch 700 and die are tight on the workpiece and the chamfered edge 870 of the top 868 of the insert 840, which is positioned adjacent to the draw stud, enters the pilot hole and causes the punch 700, the draw stud and the die to center on the pilot hole. The operator could also actuate a hydraulic punch driver until the punch 700 and the die are tight on the workpiece.

After the insert 840 enters the pilot hole to center the punch 700, the draw stud and the die on the pilot hole, the operator actuates a hand pump of the hydraulic punch driver such that hydraulic fluid forces the ram to pull the draw stud, which in turn pulls the punch 700 such that the points 738, 792 pierce through the workpiece. The inclined planar surfaces 710, 712 begin shearing the workpiece to create a hole having a diameter which is larger than a diameter of the pilot hole. A slug is created from the workpiece where the hole is formed and the slug can be split depending on the configuration of the cutting surfaces.

The points 738, 792 piercing the workpiece before the inclined planar surfaces 710, 712 shear the workpiece, minimizes the required punching force.

In the fourth embodiment, the configuration of the cutting surfaces is not important to the embodiment as long as the cutting surfaces can create a hole having a diameter D, which is larger than a diameter of the pilot hole.

While preferred embodiments of the present invention are shown and described, it is envisioned that those skilled in the art may devise various modifications without departing from the spirit and scope of the foregoing description.

What is claimed is:

1. A one-piece punch for cutting a hole in a workpiece, said workpiece having a pilot hole provided therethrough, said punch comprising:

a punch body having a bore at least partially therethrough;

at least one piercing portion extending from said punch body a predetermined distance for piercing the workpiece;

at least one cutting portion extending from said punch body a predetermined distance for shearing the workpiece after said at least one piercing portion has pierced the workpiece; and a pair of projections extending from said punch body a predetermined distance and positioned generally opposite of each other and adjacent to said bore of said punch body, said pair of projections capable of centering said punch body with the pilot hole of the workpiece, said pair of projections extending further away from said punch body than said at least one piercing portion such that at least a portion of said pair of projections enters the pilot hole of the workpiece prior to said at least one piercing portion piercing the workpiece.

2. A one-piece punch as defined in claim 1, wherein said at least one piercing portion comprises first and second piercing portions, said at least one cutting portion comprises first and second cutting portions, and said pair of projections comprise first and second projections, said first piercing portion has first and second surfaces which meet to form a point, said first surface of said first piercing portion slopes downwardly from said point of said first piercing portion toward said first projection and said first cutting portion, said second surface of said first piercing portion extends axially downwardly to said second cutting portion, said second piercing portion has first and second surfaces which meet to form a point, said first surface of said second piercing portion slopes downwardly from said point of said second piercing portion toward said second projection and said second cutting portion, said second surface of said second piercing portion extends axially downwardly to said first cutting portion.

3. A one-piece punch as defined in claim 2, wherein said first cutting portion slopes downwardly from said first surface of said first piercing portion to said second surface of said second piercing portion, and wherein said second cutting portion slopes downwardly from said first surface of said second piercing portion to said second surface of said first piercing portion, such that said first and second cutting portions slope downwardly in opposite directions.

4. A one-piece punch as defined in claim 3, wherein said first and second cutting portions have outer peripheral edges which form cutting edges on opposite sides of said punch body.

5. A one-piece punch as defined in claim 2, wherein said first projection tapers downwardly to said first surface of said first piercing portion, and wherein said second projection tapers downwardly to said first surface of said second piercing portion.

6. A one-piece punch as defined in claim 2, wherein said pair of projections extend approximately 1/16 inch further away from said punch body than said at least one piercing portion.

7. A one-piece punch as defined in claim 1, wherein said punch body, said at least one piercing portion, said at least one cutting portion and said pair of projections are all integrally formed.

8. A punch for cutting a hole in a workpiece, said workpiece having a pilot hole provided therethrough, said punch comprising:

a punch body having an axial bore therethrough;

first and second piercing portions extending from said punch body a predetermined distance for piercing the workpiece;

first and second projections extending from said punch body a predetermined distance and positioned opposite of each other and adjacent to said axial bore, said first and second projections capable of centering said punch body with the pilot hole of the workpiece, said first and second projections extending further away from said punch body than said first and second piercing portions such that said first and second projections engage the pilot hole of the workpiece prior to said first and second piercing portions piercing the workpiece; and first and second cutting portions extending from said punch body a predetermined distance for shearing the workpiece after said at least one piercing portion has pierced the workpiece, wherein said first piercing portion has first and second surfaces which meet to form a point, said first surface of said first piercing portion slopes downwardly from said point of said first piercing portion toward said axial bore and said first cutting portion, said second surface of said first piercing portion extending axially downwardly to said second cutting portion, and wherein said second piercing portion has first and second surfaces which meet to form a point, said first surface of said second piercing portion slopes downwardly from said point of said second piercing portion toward said axial bore and said second cutting portion, said second surface of said second piercing portion extends axially downwardly to said first cutting portion.

* * * * *

UNITED STATES PATENT AND TRADEMARK OFFICE

CERTIFICATE OF CORRECTION

PATENT NO. : 6,973,729 B2
DATED : December 13, 2005
INVENTOR(S) : William F. Nordling It is certified that error appears in the above-identified patent and that said Letters Patent is hereby corrected as shown below:

Title page,
Item [56], References Cited, FOREIGN PATENT DOCUMENTS, insert the following:

| | | |
|---|---|---|
| -- DE | 19803814 | 08/1999 |
| DE | 19613153 | 10/1997 --. |

Column 7,
Line 3, "such that the points" should be -- such that the draw stud and the die on the pilot holes the points --.

Signed and Sealed this

Fourth Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,973,729 B2
APPLICATION NO. : 10/085730
DATED : December 13, 2005
INVENTOR(S) : William F. Nordling It is certified that error appears in the above-identified patent and that said Letters Patent is hereby corrected as shown below:

Item [56]

The following FOREIGN PATENT DOCUMENTS were omitted:

Please Insert

| | | |
|---|---|---|
| DE | 19803814 | 08/1999 |
| DE | 19613153 | 10/1997 |

Signed and Sealed this

Fifth Day of September, 2006

JON W. DUDAS
*Director of the United States Patent and Trademark Office*